US007550715B2

(12) United States Patent
Omura et al.

(10) Patent No.: US 7,550,715 B2
(45) Date of Patent: Jun. 23, 2009

(54) FAST ATOM BOMBARDMENT SOURCE, FAST ATOM BEAM EMISSION METHOD, AND SURFACE MODIFICATION APPARATUS

(75) Inventors: Takashi Omura, Osaka (JP); Shinji Ishitani, Hyogo (JP); Naoki Suzuki, Osaka (JP)

(73) Assignee: Panasonic Corporation, Osaka (JP)

( * ) Notice: Subject to any disclaimer, the term of this patent is extended or adjusted under 35 U.S.C. 154(b) by 267 days.

(21) Appl. No.: 11/790,611

(22) Filed: Apr. 26, 2007

(65) Prior Publication Data

US 2007/0284539 A1 Dec. 13, 2007

(30) Foreign Application Priority Data

Apr. 27, 2006 (JP) ..... 2006-123166

(51) Int. Cl.
*H05H 3/02* (2006.01)

(52) U.S. Cl. ..... 250/251

(58) Field of Classification Search ..... 250/251
See application file for complete search history.

(56) References Cited

U.S. PATENT DOCUMENTS 5,519,213 A * 5/1996 Hatakeyama ..... 250/251
5,640,009 A * 6/1997 Hatakeyama ..... 250/251

FOREIGN PATENT DOCUMENTS

| | | |
|---|---|---|
| EP | 0 531 949 | 3/1993 |
| EP | 0 790 757 | 8/1997 |
| EP | 1 220 272 | 7/2002 |
| JP | 2509488 | 4/1996 |
| JP | 3064214 | 5/2000 |
| JP | 3103181 | 8/2000 |
| JP | 2002-289399 | 10/2002 |
| JP | 2002-289582 | 10/2002 |
| JP | 2002-289583 | 10/2002 |
| JP | 2002-289584 | 10/2002 |
| JP | 2002-289585 | 10/2002 |
| JP | 3363040 | 10/2002 |
| JP | 2003-109942 | 4/2003 |
| JP | 3423543 | 4/2003 |
| JP | 2004-281228 | 10/2004 |
| JP | 2004-281231 | 10/2004 |

OTHER PUBLICATIONS

European Office Action (in English language) issued in Application No. GB 0707929.6 dated Aug. 31, 2007.

* cited by examiner

*Primary Examiner*—Kiet T Nguyen
(74) *Attorney, Agent, or Firm*—Wenderoth, Lind & Ponack, L.L.P.

(57) ABSTRACT

A positive electrode drive unit enables a positive electrode to be repeatedly rotated about the center of the positive electrode to vary a distance between the positive electrode and an atom emission unit. A control unit receives input data which is set to obtain a desired atom density distribution by displacement of the positive electrode, and the control unit outputs a drive control signal for displacing the positive electrode to the positive electrode drive unit. The positive electrode drive unit is stopped during running by the control unit, or a drive speed of the positive electrode drive unit is changed by the control unit. Therefore, a residence time of each attitude is changed in the positive electrode to vary the atom density per unit time.

9 Claims, 18 Drawing Sheets

FAST ATOM BOMBARDMENT SOURCE, FAST ATOM BEAM EMISSION METHOD, AND SURFACE MODIFICATION APPARATUS

BACKGROUND OF THE INVENTION

The present invention relates to a fast atom bombardment source (FAB (Fast Atom Bombardment) or saddle field source) and a fast atom beam emission method for generating plasma to emit atoms, and a surface treatment apparatus (for example, surface modification apparatus) provided with the fast atom bombardment source.

An atom beam which has kinetic energy much larger than those of atoms and molecules existing in the atmosphere at room temperature and a directional property is called fast atom beam, and an apparatus which generates the fast atom beam is called fast atom bombardment source.

The fast atom bombardment source is mainly used for a processing step in a semiconductor device production process. The feature of the fast atom bombardment source is that a target to be processed is not charged unlike in the case of using an ion beam. Therefore, the fast atom bombardment source can be used even when the charge possibly damages the target or even when desired process accuracy cannot possibly be ensured by the charge depending on a characteristic of the target.

However, in the conventional fast atom bombardment source, there is an issue that density of the emitted atom beam is hardly equalized. In order to solve the issue, Japanese Examined Patent Publication No. 3363040 discloses a technique of equalizing a planar distribution of the atoms emitted from the fast atom bombardment source.

In a configuration of the fast atom bombardment source disclosed in Japanese Examined Patent Publication No. 3363040, an emission electrode or a gas introduction electrode which has a plurality of holes is provided in an electric-discharge vessel which generates the plasma, and lengths or diameters of the holes are set so as to differ from one another depending on their positions, whereby evenness of the distribution of the emitted atoms is achieved.

However, a distance between the atom bombardment source and the target sometimes becomes uneven depending on a shape of the target to be processed and the configuration of installation. Additionally, in the case where the target such as a wafer larger than a chip is processed, or in the case where an etching rate is enhanced, or in structure of equipment, the distance between the atom bombardment source and the target sometimes becomes uneven. In such cases, when the target is irradiated with the fast atoms, the density of the atoms impinging on the target is not equalized, and a structure of the target is not matched with design, which results in generation of a defect.

Furthermore, in the conventional technique, it is necessary to change the structure of the atom bombardment source when the amount of processing or target to be processed is changed, which increases cost.

In view of the foregoing, an object of the present invention is to provide a fast atom bombardment source, a fast atom beam emission method, and a surface modification apparatus which enable the desired emission atom density distribution per unit time to be inexpensively achieved in short time.

SUMMARY OF THE INVENTION

In order to achieve the above object, the invention is configured as follows.

According to a first aspect of the present invention, there is provided an atom bombardment source comprising:

a cylindrical body which is partially opened, serves as a negative electrode and having an emission unit capable of emitting atoms, for generating plasma therein;

a positive electrode which is arranged in the cylindrical body;

a power supply which is electrically connected to the positive electrode, for applying a voltage to the positive electrode to generate the plasma in the cylindrical body to emit the atoms from the emission unit; and a positive electrode drive unit for displacing the positive electrode with respect to the emission unit in the cylindrical body.

According to a second aspect of the present invention, there is provided the atom bombardment source according to the first aspect, wherein the positive electrode is formed in a rod or a ring.

According to a third aspect of the present invention, there is provided the atom bombardment source according to the first or second aspect, further comprising a control unit for controlling the positive electrode drive unit to displace the positive electrode to be brought close to or separated away from the emission unit at predetermined intervals.

According to a fourth aspect of the present invention, there is provided the atom bombardment source according to any one of the first to third aspects, further comprising a control unit for controlling the voltage applied to the positive electrode from the power supply in association with the displacement of the positive electrode.

According to a fifth aspect of the present invention, there is provided an atom beam emission method comprising:

applying a voltage to a positive electrode in a cylindrical body with the cylindrical body set to a negative electrode to generate plasma in the cylindrical body;

emitting atoms from an emission unit capable of emitting the atoms with a part of the cylindrical body having an opening serving as the negative electrode; and displacing the positive electrode with respect to the emission unit in the cylindrical body by use of a positive electrode drive unit.

According to a sixth aspect of the present invention, there is provided the atom beam emission method according to the fifth aspect, wherein the plasma is generated in the cylindrical body to emit the atoms from the emission unit while the positive electrode drive unit is controlled to displace the positive electrode with respect to the emission unit at predetermined intervals.

According to a seventh aspect of the present invention, there is provided the atom beam emission method according to the fifth or sixth aspect, wherein with a plurality of rod-shaped positive electrodes arranged as the positive electrode, with longitudinal axis directions of the plurality of rod-shaped positive electrodes substantially parallel to the emission unit and with the emission unit inclined with respect to a surface of a target to which the atoms are emitted, at least the positive electrode which is located close to the target is displaced with respect to the emission unit in the plurality of rod-shaped positive electrodes while the plasma is generated in the cylindrical body to emit the atoms from the emission unit.

According to an eighth aspect of the present invention, there is provided the atom beam emission method according to any one of the fifth to seventh aspects, wherein the plasma is generated in the cylindrical body to emit the atoms from the opening while the voltage applied to the positive electrode from a power supply is controlled in association with the displacement of the positive electrode.

According to a ninth aspect of the present invention, there is provided a surface modification apparatus for emitting atoms to a target from an atom bombardment source to perform surface modification of the target, plasma being generated in a cylindrical body of the atom bombardment source, in which an emission center axis along which the atoms are emitted from the atom bombardment source is obliquely provided with respect to an axis perpendicular to a surface of the target placed on a placement stage, and the atom bombardment source is formed by the atom bombardment source according to any one of the first to third aspects.

In the above configurations, the rod- or ring-shaped positive electrode is provided inside the cylindrical body of the negative electrode which generates the plasma to emit the atoms, the positive electrode in the cylindrical body is enabled to be displaced with respect to the target such that the optimum emission atom density distribution per unit time is obtained, and the electron density is controlled in the discharge space, which allows the desired processing capacity to be ensured.

According to the present invention, the positive electrode in the cylindrical body which is of the negative electrode is displaced to control the electron density in the discharge space. Therefore, the desired emission atom density distribution per unit time can inexpensively be obtained in short time, and the good surface treatment can be performed in the surface modification apparatus.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
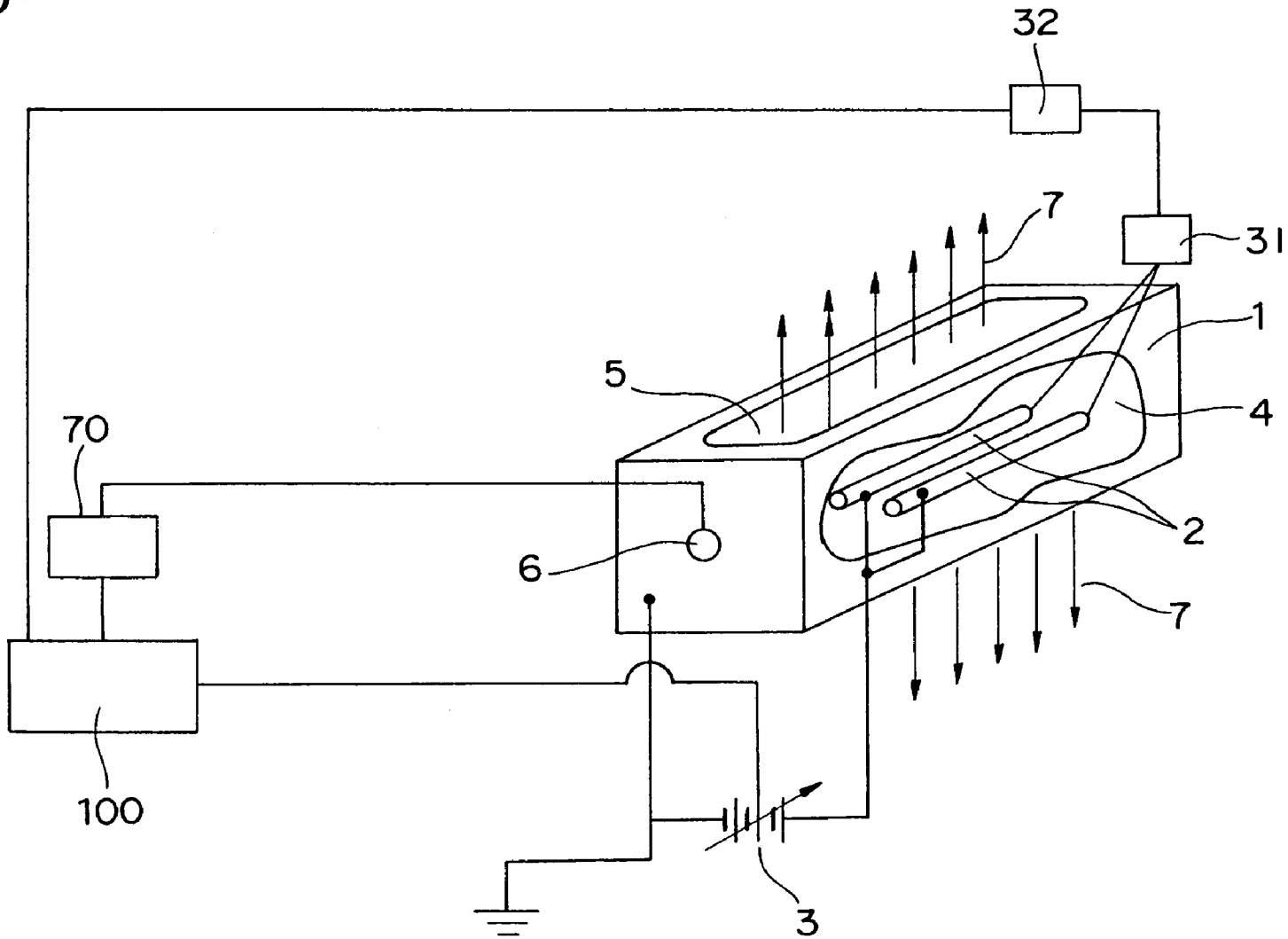
FIG. 1 is a perspective view showing a fast atom bombardment source according to a first embodiment of the present invention where the fast atom bombardment source is partially broken.

Before the description of the present invention proceeds, it is to be noted that like parts are designated by like reference numerals throughout the accompanying drawings.

Preferred embodiments of the invention will be described below with reference to the accompanying drawings.

FIG. 1 is a perspective view showing a fast atom bombardment source according to a first embodiment of the present invention where the fast atom bombardment source is partially broken. Referring to FIG. 1, the fast atom bombardment source includes an outer frame 1 (an example of a cylindrical body, the outer frame is shown by a rectangular-parallelepiped cylindrical body in FIG. 1), a plurality of rod-shaped positive electrodes 2 which are arranged inside the outer frame 1 parallel to one another, a direct-current high-voltage power supply 3 which is arranged outside the outer frame 1, a discharge space 4 which is located inside the outer frame 1, an atom emission unit 5 which is arranged in one surface of the outer frame 1 to connect the outside of the outer frame 1 and the discharge space 4, and a gas introduction unit 6 which is arranged in one surface of the outer frame 1. The numeral 7 designates an atom beam emitted.

In FIG. 1, the outer frame 1 of the fast atom bombardment source is made of an insulating material or a conductive material connected to the ground. The direct-current high-voltage power supply 3 is connected to the plurality of positive electrodes 2 provided inside the outer frame 1, and a voltage ranging from 2 kV to 3 kV as examples is applied to the plurality of positive electrodes 2 respectively. The atom emission unit 5 which has openings connecting the outside and the discharge space 4 is provided in a portion (at least in a surface along a direction parallel to an axial direction of the positive electrode 2, upper and lower surfaces in FIG. 1) of the outer frame 1. The atom emission unit 5 is electrically connected to the conductive material portion of the outer frame 1, and the atom emission unit 5 and the outer frame 1 function as the negative electrode. The atom emission unit 5 is usually formed in a conductive plate having a number of through holes. Although the upper and lower surfaces are provided as the atom emission unit 5 in FIG. 1, preferably one of the upper and lower surfaces is provided in order to efficiently generate the fast atom beam. As one example, the plurality of positive electrodes 2 are arranged in substantially parallel with one another while being separated away from the upper and lower atom emission units 5 by the same distance.

The gas introduction unit 6 is provided in a portion (in FIG. 1, in a left side-sideface orthogonal to the upper surface in which the atom emission unit 5 is arranged) of the outer frame 1 to introduce discharge gas from the outside of the outer frame 1. The gas introduction unit 6 is not limited to the arrangement in FIG. 1, but the gas introduction unit 6 is preferably arranged at an optimum position where the plasma is stabilized according to the shape of the outer frame 1 and the shape and position of the positive electrode 2. A gas supply device 70 is coupled to the gas introduction unit 6, and the gas necessary for forming the plasma is supplied from the gas supply device 70 to the discharge space 4 in the outer frame 1 through the gas introduction unit 6 under the control of a control device 100.

The outer frame 1 can be designed in any shape as long as the desired density of the atom beam 7 is obtained. In the arrangement of the atom emission unit 5, the number of installation, the direction, and the location can be arbitrarily set as long as the desired density of the atom beam 7 is obtained. In the first embodiment, as one example, the atom emission unit 5 shown in FIG. 1 is arranged at the position where the emission atom density is relatively high.

The gas supply device 70 introduces the gas for forming the plasma such as Ar, $N_2$, He, H, $O_2$, and $H_2O$ from the gas introduction unit 6 to the discharge space 4, a pressure reducing device 71 reduces a pressure of the discharge space 4 to about 100 Pa or less, and the direct-current high-voltage power supply 3 applies a direct-current voltage to the positive electrode 2 to form the plasma in the discharge space 4. In order to form the plasma in the discharge space 4, the control device 100 respectively controls the operations of the gas supply device 70, the pressure reducing device 71, the direct-current high-voltage power supply 3, and a control unit 32 connected to a positive electrode drive device 31.

Figure 2A:
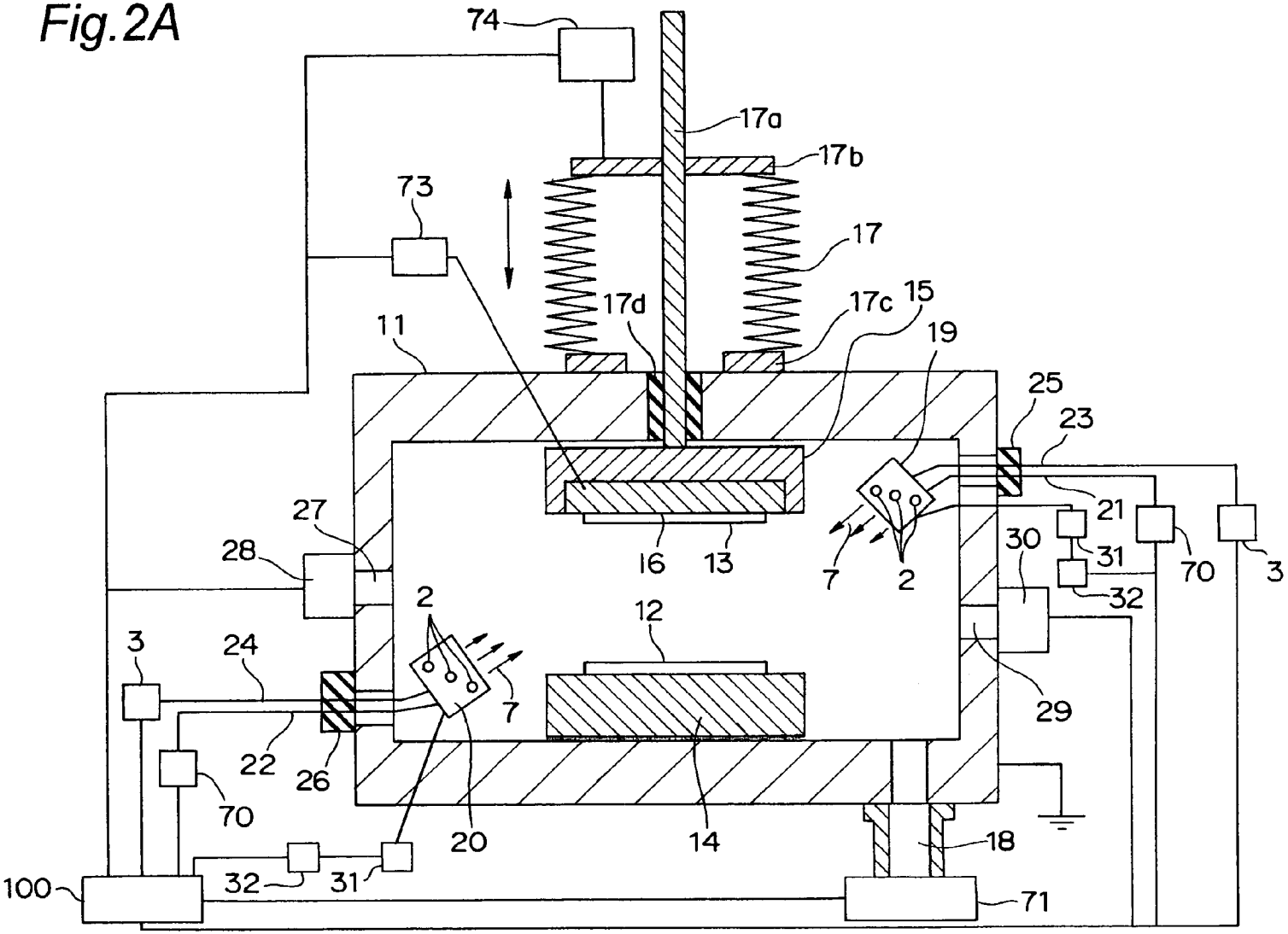
FIG. 2A is a schematic view showing a configuration of a surface modification apparatus provided with the fast atom bombardment source according to the first embodiment.

FIG. 2A is a schematic view showing a configuration of a surface modification apparatus which is of an example of the surface treatment apparatus provided with the fast atom bombardment source of the first embodiment according to the present invention. Referring to FIG. 2A, the reference numeral 11 designates a reaction chamber which is formed by a reaction vessel, the reference numeral 12 designates one of substrates which is a treatment target, and the reference numeral 13 designates the other substrate which is a treatment target. For example, the substrates 12 and 13 are made of Si (silicon). The control device 100 controls the operations of the pressure reducing device 71, the fast atom bombardment sources 19 and 20, and a bellows drive device 74. Each of the fast atom bombardment sources 19 and 20 includes the gas supply device 70, the direct-current high-voltage power supply 3, and the control unit 32 connected to the positive electrode drive device 31. Analysis result information is inputted to the control device 100 from mass spectrometers 28 and 30, and the control device 100 controls to form the plasma in the discharge space 4 to perform the surface modification of the substrates 12, 13.

The one substrate 12 is placed on a lower substrate stage 14, and the other substrate 13 is fixed to an upper substrate stage 15. An electrostatic chuck 16 is embedded in the upper substrate stage 15. A voltage applying device 73 applies a voltage to the electrostatic chuck 16, and thereby the other substrate 13 is electrostatically attracted to the electrostatic chuck 16. The upper substrate stage 15 is attached to the bellows 17 so as to be moved up and down with respect to the reaction chamber 11. That is, a lower end of the bellows 17 is fixed to a ring-shaped fixed plate 17*c* which is fixed to the upper surface of the reaction chamber 11, and an upper end of the bellows 17 is fixed to a fixed plate 17*b*. A support rod 17*a* is fixed to the fixed plate 17*b* while penetrating through the fixed plate 17*b*. In the lower portion of the support rod 17*a* penetrates through the reaction chamber 11, and the upper substrate stage 15 is fixed to the lower end of the support rod 17*a*. The bellows 17 is connected to the bellows drive device 74 such as an air pump, the bellows 17 is expanded and contracted by driving the bellows drive device 74, and the support rod 17*a* is moved up and down by the fixed plate 17*b*. Therefore, the upper substrate stage 15 can be moved up and down. That is, when the bellows 17 is vertically moved, the upper substrate stage 15 coupled to the bellows 17 can be vertically moved to bring the other substrate 13 into press-contact with the one substrate 12 after the surface modification is performed to the opposing surfaces of the substrates 12 and 13.

The reference numeral 18 designates an evacuating port of the reaction chamber 11. The pressure reducing device 71 evacuates the inside of the reaction chamber 11 to reduce the pressure therein. The first fast atom bombardment source 19 (for example, fast atom bombardment source in FIG. 1) emits the fast atom beam 7 to modify the one substrate 12, and the second fast atom bombardment source 20 (for example, fast atom bombardment source in FIG. 1) emits the fast atom beam 7 to modify the other substrate 13. Gas supply pipes 21 and 22 and electric power supply wires 23 and 24 are connected to the fast atom bombardment sources 19 and 20 respectively. The electric power supply wires 23 and 24 are used to apply voltages to the positive electrodes 2. The gas supply pipes 21 and 22 and the electric power supply wires 23 and 24 can maintain a degree of vacuum of the reaction chamber 11 by supply connectors 25 and 26. The support rod 17*a* can also maintain the degree of vacuum of the reaction chamber 11 by a seal 17*d*.

A mass spectroscopic port 27 takes in elements emitted from the surface of the substrate 12 when the surface of the substrate 12 is cleaned by irradiating the surface with the fast atom beam 7 from the first fast atom bombardment source 19. The mass spectrometer 28 is coupled to the mass spectroscopic port 27. A mass spectroscopic port 29 takes in elements emitted from the surface of the substrate 13 when the surface of the substrate 13 is cleaned by irradiating the surface with the fast atom beam 7 from the second fast atom bombardment source 20. The mass spectrometer 30 is coupled to the mass spectroscopic port 29. The mass spectroscopy is performed to the substrates 12 and 13 using the mass spectrometers 29 and 30 respectively, and the control device 100 controls a cleaning operation based on analysis result information, which allows the desired cleaning to be performed to the substrates 12 and 13.

In operating the fast atom bombardment source and the surface modification apparatus described above, the atoms are neutralized when the accelerated ions in the plasma collide with another ions, the atoms, electrons, an outer frame inner wall of the discharge space 4, and the positive electrode 2, and then, the atoms pass through the atom emission unit 5 to form the atom beam 7. The atom density of the atom beam 7 is largely affected by electron density between the atom emission unit 5 and the positive electrode 2 in the discharge space 4.

Figure 3A:
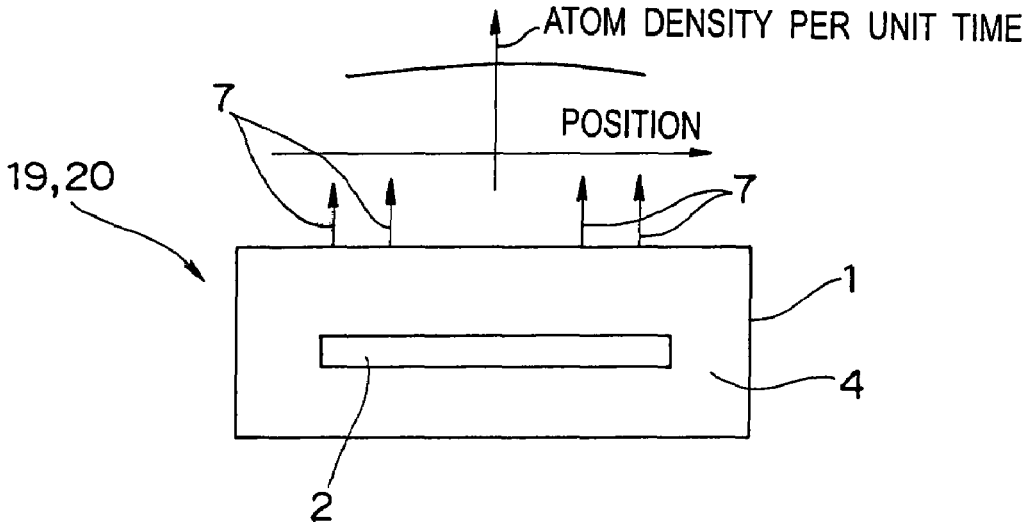
FIG. 3A is an explanatory view showing an emission atom density distribution of the fast atom bombardment source (more specifically, its upper-side view of FIG. 3A being a graph showing an emission atom density distribution with respect to positions of an atom emission unit, and its lower-side view of FIG. 3A being a side view of the fast atom bombardment source)
Figure 3B:
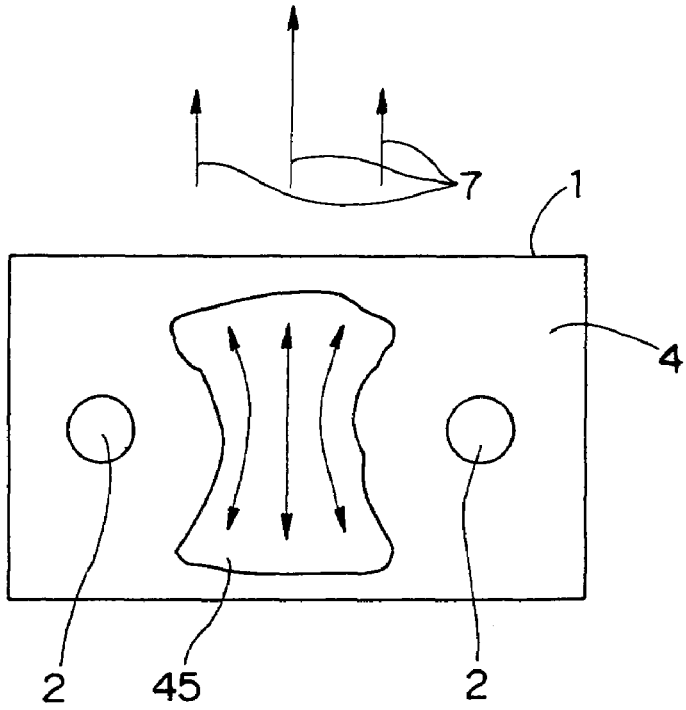
FIG. 3B is a planar explanatory view showing the emission atom density distribution of the fast atom bombardment source in FIG. 3A.
Figure 5:
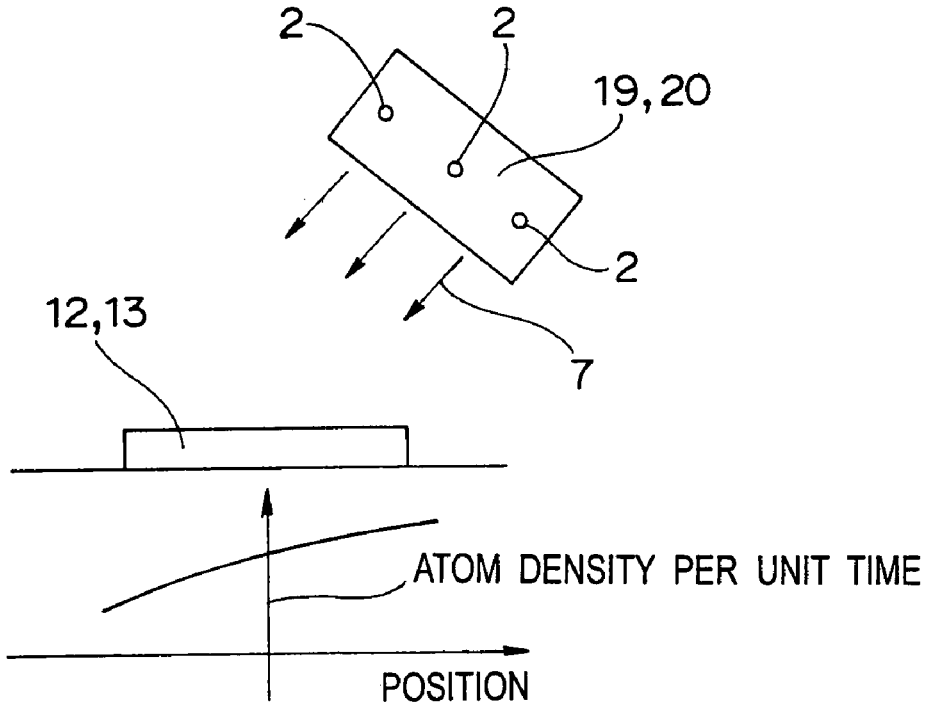
FIG. 5 is an explanatory view showing a density distribution of atoms impinging on a target when the target is obliquely irradiated with the atoms emitted from the fast atom bombardment source as in a conventional arrangement (more specifically, its upper-side view of FIG. 5 being a view showing a state where irradiation of the fast atom bombardment source is subjected to a target, and its lower-side view of FIG. 5 being a graph showing an emission atom density distribution with respect to positions of an atom emission unit)

As shown in FIGS. 3A and 3B, the plurality of positive electrodes 2 are arranged while being separated away from the atom emission unit 5 by the same distance respectively, and each of the substrates 12 and 13 is arranged in substantially parallel with the surface of the atom emission unit 5 which is arranged only on the upper side of the outer frame 1. Because the distance between the positive electrode 2 and each point in the surface of each of the substrates 12 and 13 is kept constant, emission atom density of the fast atom bombardment sources 19 and 20 shown in FIG. 1, i.e., the density of the atoms impinging on the surfaces of the substrates 12 and 13 is usually equalized and kept constant. FIG. 3B schematically shows plasma 45 formed in an intermediate portion between the two positive electrodes 2. However, as shown in FIG. 5, in the case where the substrates 12 and 13 which are the treatment targets are simply obliquely irradiated with the fast atom beams 7 from the fast atom bombardment sources 19 and 20 while the position of the positive electrode 2 is fixed in the outer frame 1 as in the conventional technique, the density of the atoms impinging on the surfaces of the substrates 12 and 13 become actually uneven, because the distances between the positive electrode 2 and the points in the surface of each of the substrates 12 and 13 are not kept constant. In FIG. 5, the distances between the surfaces of the substrates 12 and 13 and the positive electrodes 2 located on the obliquely lower-right sides of the fast atom bombardment sources 19 and 20 become shortest, and the atom density per unit time is increased. On the other hand, the distances between the surfaces of the substrates 12 and 13 and the positive electrodes 2 located on the obliquely upper-left sides of the fast atom bombardment sources 19 and 20 become longest, and the atom density per unit time is decreased. Therefore, the density of the atoms impinging on the surfaces of the substrates 12 and 13 becomes uneven.

Figure 4A:
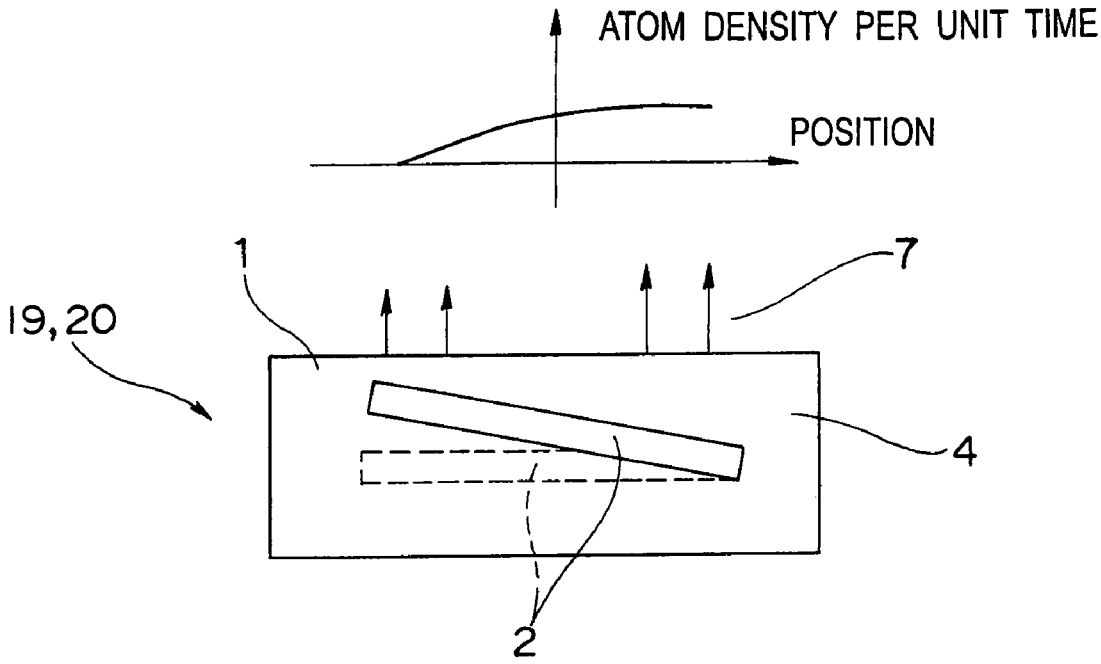
FIG. 4A is an explanatory view showing an emission atom density distribution of the fast atom bombardment source in the first embodiment according to the present invention when a positive electrode is displaced (more specifically, its upper-side view of FIG. 4A being a graph showing an emission atom density distribution with respect to positions of an atom emission unit, and its lower-side view of FIG. 4A being a side view of the fast atom bombardment source)
Figure 4B:
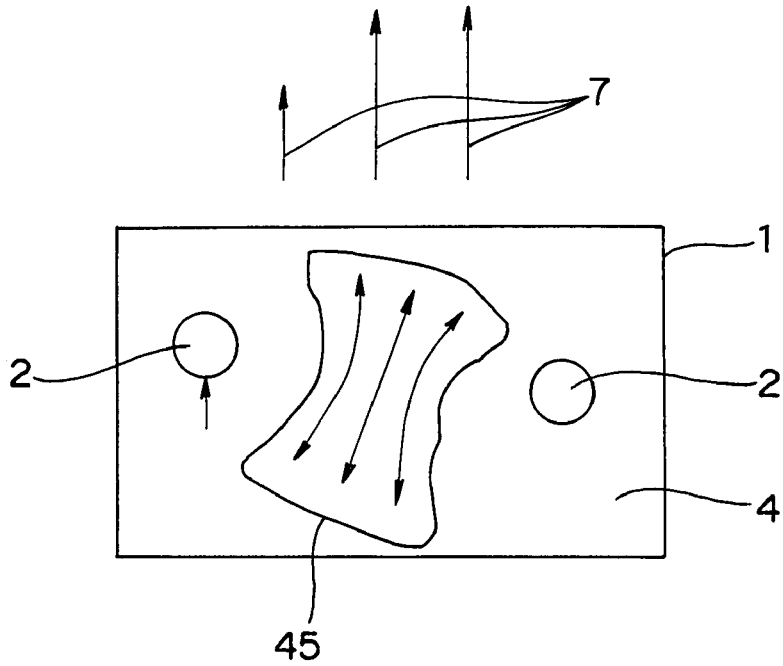
FIG. 4B is a planar explanatory view showing the emission atom density distribution of the fast atom bombardment source and schematically showing plasma rightward-obliquely formed in an intermediate portion between the two positive electrodes when only the left-side positive electrode is displaced in the fast atom bombardment source as shown in FIG. 4A.
Figure 4C:
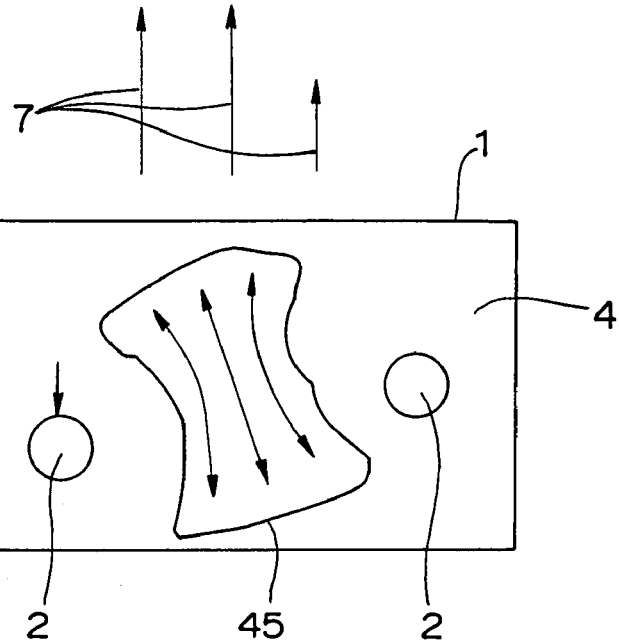
FIG. 4C is a planar explanatory view showing the emission atom density distribution of the fast atom bombardment source and schematically showing plasma leftward-obliquely formed in an intermediate portion between the two positive electrodes when only the left-side positive electrode is displaced in the direction opposite to that in FIG. 4A so as to be separated away from a negative electrode in the fast atom bombardment source of FIG. 4A.

As shown in FIG. 4A, when the position of the positive electrode 2 in the discharge space 4 is brought close to the outer frame-1-side which is of the negative electrode, e.g., when the one end portion (left end portion of FIG. 4A) in a longitudinal direction of the positive electrode 2 is brought close to the outer frame-1-side which is of the negative electrode while the other end portion (right end portion of FIG. 4A) is set to a support point, kinetic energy of the ions attracted from the positive electrode 2 to the negative electrode is decreased. FIG. 4B schematically shows the plasma 45 which is rightward-obliquely formed in an intermediate portion between the two positive electrodes 2 when only the left-side positive electrode 2 is displaced in the fast atom bombardment source of FIG. 4A. FIG. 4C schematically shows the plasma 45 which is leftward-obliquely formed in the intermediate portion between the two positive electrodes 2 when only the left-side positive electrode is displaced in the direction opposite to that in FIG. 4A so as to be separated away from the negative electrode in the fast atom bombardment source of FIG. 4A. In the electrons which are cyclically moved around the positive electrode 2, the collision with the wall of the outer frame 1 is increased to decrease the electron density by shortening the distance between the positive electrode 2 and the negative electrode. As a result, the number of atoms neutralized by the collision is decreased, and the emission atom density is decreased.

Figure 6:
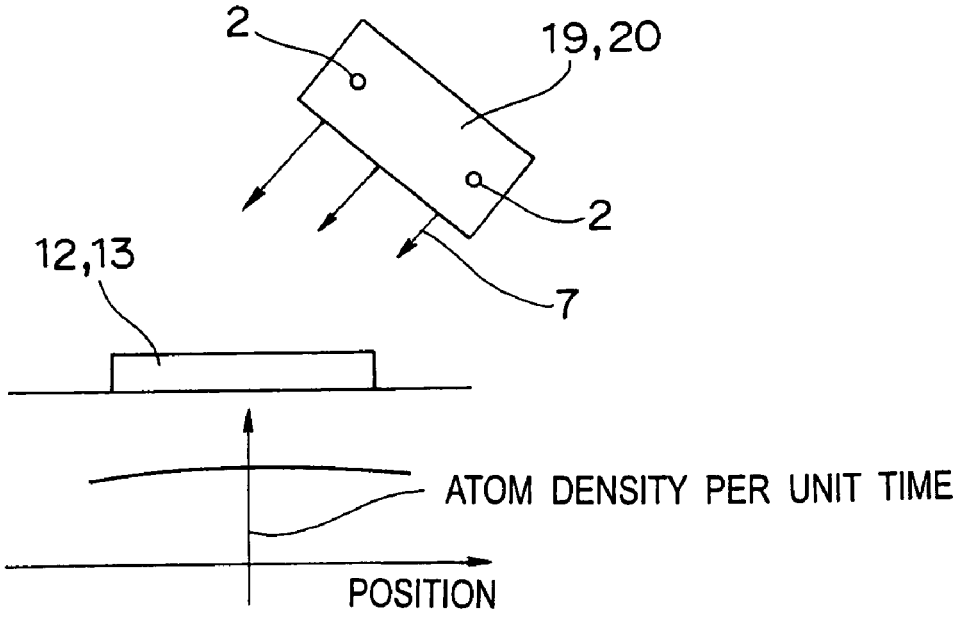
FIG. 6 is an explanatory view showing a density distribution of atoms impinging on a target when the target is obliquely irradiated with the atoms emitted from the fast atom bombardment source according to the first embodiment (more specifically, its upper-side view of FIG. 6 being a view showing a state where irradiation of the fast atom bombardment source is subjected to a target, and its lower-side view of FIG. 6 being a graph showing an emission atom density distribution with respect to positions of an atom emission unit)

As described later, the control is performed such that the position of the positive electrode 2 is changed (the control is performed such that the positive electrode 2 is displaced), and thereby a gradient can be given to the positive electrode 2 in order to obtain the desired emission atom density per unit time. As shown in FIG. 6, the substrates 12 and 13 are obliquely irradiated with the fast atom beams 7 from the fast atom bombardment sources 19 and 20, and the position of the positive electrodes 2 are changed such that the density of the atoms impinging on the substrates 12 and 13 becomes even, namely, the control is performed such that the positive electrodes 2 are displaced. Therefore, the processing can evenly be performed by the atom beams 7.

Specifically, the plurality of rod-shaped positive electrodes 2, for example, are arranged, and the positive electrode 2 (positive electrode 2 on the upper-left side in FIG. 6) located on the far side of each of the substrates 12 and 13 in the plurality of rod-shaped positive electrodes 2 is displaced with (brought close to) respect to the emission unit 5 while the plasma is generated in the outer frame 1 to emit the atoms from the emission unit 5 in the state in which the longitudinal axis directions of the plurality of rod-shaped positive electrodes 2 are substantially parallel to the emission unit 5 and in the state in which the emission unit 5 is inclined with respect to the surfaces of the substrates 12 and 13 which are examples of the targets to which the atoms are emitted. This enables the substantially even plasma 45 like FIG. 3B to be formed between the positive electrodes 2 to substantially equalize the density of the atoms impinging on the surfaces of the substrates 12 and 13 in the fast atom beams 7.

Figure 7:
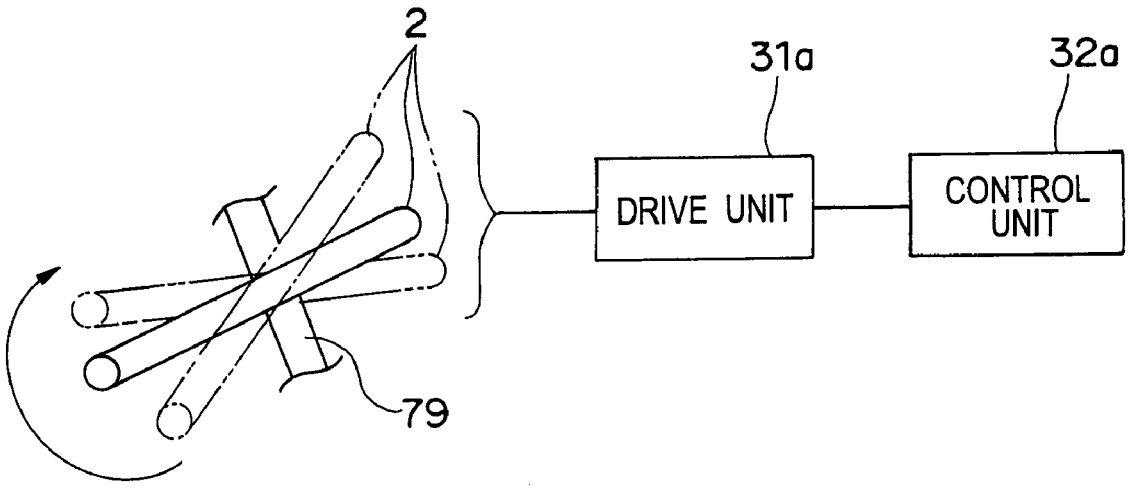
FIG. 7 is an explanatory view showing an arrangement example and its displacement operation of the positive electrode in the first embodiment.
Figure 8:
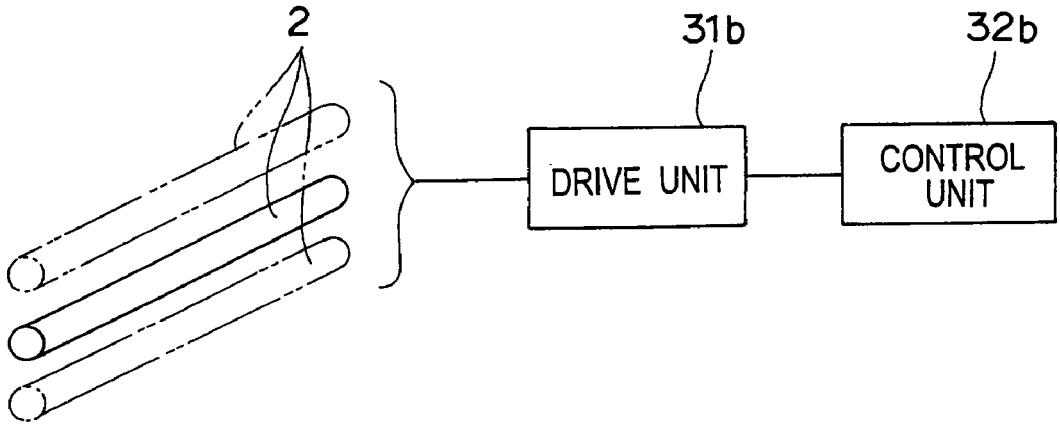
FIG. 8 is an explanatory view showing another arrangement example and its displacement operation of the positive electrode in the first embodiment.
Figure 9:
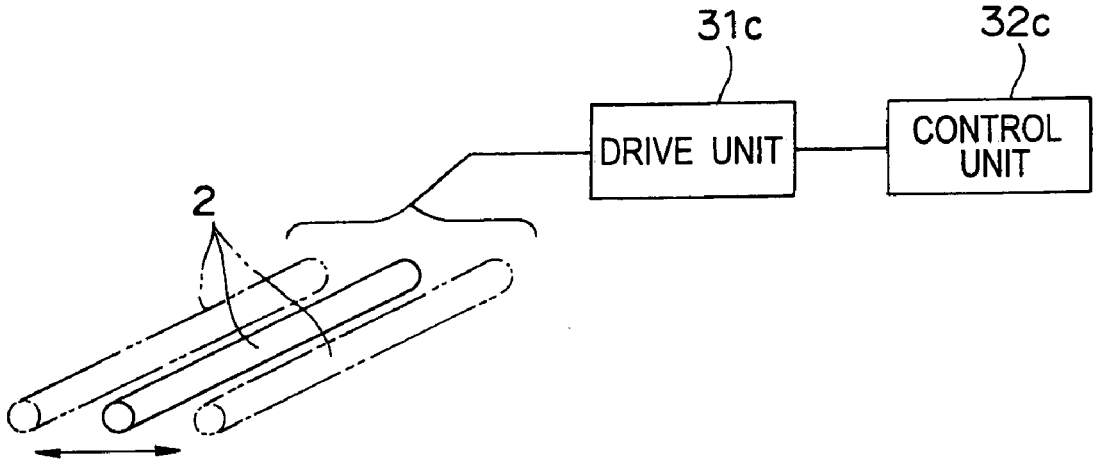
FIG. 9 is an explanatory view showing still another arrangement example and its displacement operation of the positive electrode in the first embodiment.

FIGS. 7 to 9 are explanatory views showing examples of arrangements and displacement operations of the positive electrode in the first embodiment.

Referring to FIG. 7, a positive electrode drive unit 31*a* is an example of the positive electrode drive unit 31, and a control unit 32*a* is an example of the control unit 32. The positive electrode drive unit 31*a* enables the rod-shaped positive electrode 2 to be repeatedly rotated about the center of the positive electrode 2 to vary the distance between the positive electrode 2 and the atom emission unit 5. The control unit 32*a* receives the input data which is set to obtain the desired atom density distribution by the displacement of the positive electrode 2, and the control unit 32*a* outputs a drive control signal for displacing the positive electrode 2 to a motor 81 of the positive electrode drive unit 31*a*.

With respect to the displacement operation of the positive electrode 2, the positive electrode 2 is not swung about the center of the positive electrode 2, but the positive electrode 2 may horizontally be transferred. Any operation may be performed to the displacement operation of the positive electrode 2 as long as the displacement operation does not obstruct the plasma discharge. Examples of the displacement operation of the positive electrode 2 include simple motion away from the atom emission unit 5, simple motion toward the atom emission unit 5, and motion in which the positive electrode 2 is brought close to and separated away from the atom emission unit 5 with the plasma generation position as the center. Because the simple motion away from the atom emission unit 5 and the simple motion toward the atom emission unit 5 are easily controlled, the atom density distribution can be increased and decreased as a whole. On the other hand, in the case of the motion in which the positive electrode 2 is brought close to and separated away from the atom emission unit 5 with the plasma generation position at the center, the atom density distribution on one end side in the longitudinal direction of the positive electrode 2 can relatively be increased and decreased with respect to the atom density distribution on the other end side, and the atom density distribution can partially be increased and decreased.

Figure 2B:
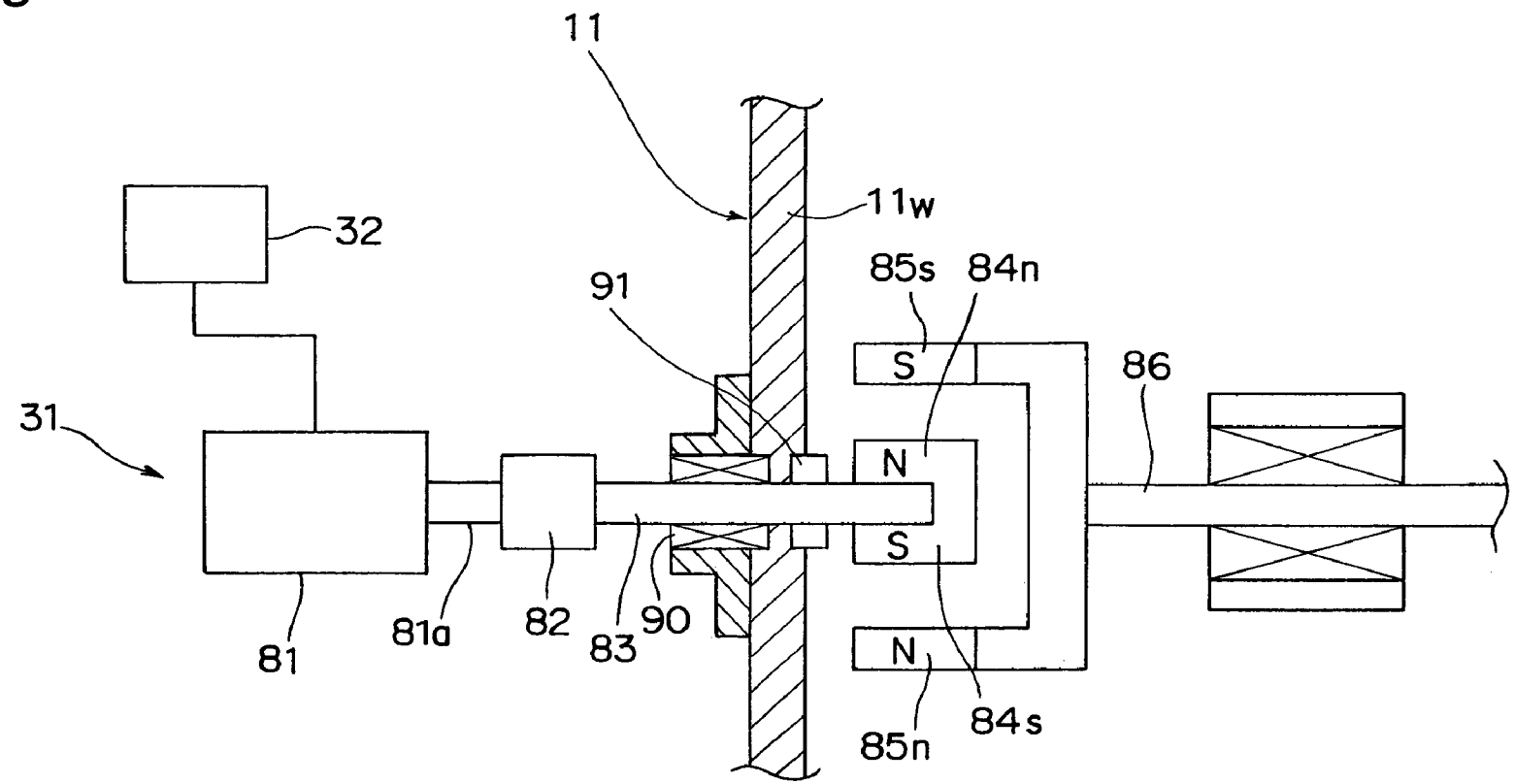
FIG. 2B is a schematic view partially showing an example of a configuration of a positive electrode drive unit in the surface modification apparatus.
Figure 2C:
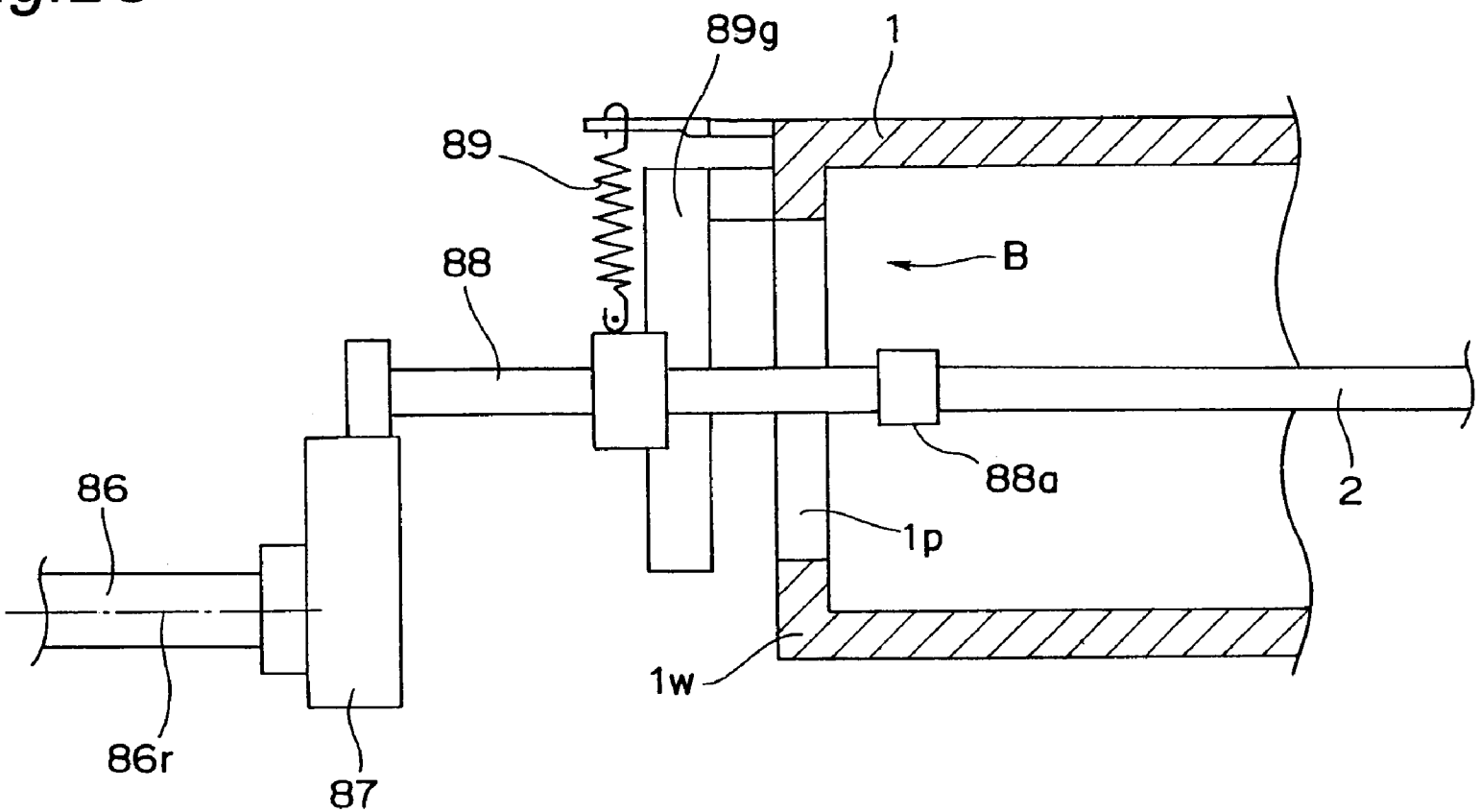
FIG. 2C is a schematic view partially showing an example of a configuration of the positive electrode drive unit in the surface modification apparatus.
Figure 2D:
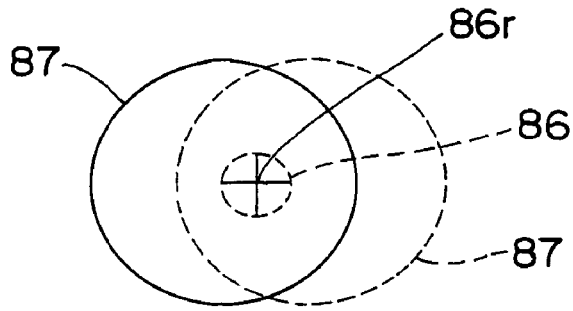
FIG. 2D is a schematic view showing a configuration of a cam portion of one example of the positive electrode drive unit in the surface modification apparatus when viewed from a direction shown by an arrow A in FIG. 2C.
Figure 2E:
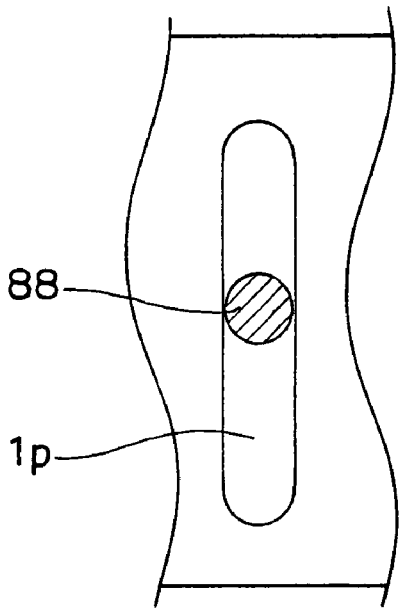
FIG. 2E is a schematic view showing a configuration of a long hole portion of an example of the positive electrode drive unit in the surface modification apparatus when viewed from a direction shown by an arrow B in FIG. 2C.

Although not shown specifically, the positive electrode drive unit 31*a* includes a positive electrode drive source such as a motor, a cylinder, or an electromagnet and a driving force transmission mechanism. Specifically, as shown in FIGS. 2B and 2C, using a magnet, the positive electrode drive unit 31*a* transmits torque to the inside of the reaction chamber 11 from the drive source located outside the reaction chamber 11, and a cam mechanism displaces the positive electrode 2 near the fast atom bombardment source 19 or 20 in the reaction chamber 11. As one example, as shown in FIG. 2B, a motor 81 which is an example of the positive electrode drive source is arranged outside the reaction chamber 11. A coupling 82 is coupled to a rotating shaft 81*a* of the motor 81. A drive shaft 83 which is coupled to the rotating shaft 81*a* of the motor 81 by the coupling 82 penetrates through a wall 11*w* of the reaction chamber 11, and the drive shaft 83 is arranged so as to be rotatably supported with respect to the wall 11*w* by the bearing 90. A seal 91 maintains a reduced pressure state of the reaction chamber 11. Drive-side magnets 84*n* and 84*s* having an N pole and an S pole are fixed to a columnar portion of the drive shaft 83, which is located at the end portion inside the outer frame 1. Driven-side magnets 85*s* and 85*n* having an S pole and an N pole are arranged around the drive-side magnets 84*n* and 84*s* having the N pole and the S pole, and the driven-side magnets 85*s* and 85*n* are fixed to a cylindrical portion on an end portion side of the driven shaft 86 with a gap between the driven-side magnets 85*s* and 85*n* and the drive-side magnets 84*n* and 84*s*. The driven-side magnets 85*s* and 85*n* and the drive-side magnets 84*n* and 84*s* are magnetically attracted to each other. The driven-side magnets 85*s* and 85*n* are simultaneously rotated according to the rotations of the drive-side magnets 84*n* and 84*s*, which allows the torque to be transmitted from the motor 81 to the driven shaft 86 in a non-contact manner. As shown in FIG. 2C, an eccentric cam 87 is fixed to the inner end portion of the driven shaft 86, and the eccentric cam 87 is eccentrically rotated about a rotating shaft 86*r* of the driven shaft 86 by the rotation of the driven shaft 86 (see FIG. 2D). A cam follower 88 is biased so as to be always in contact with the eccentric cam 87 by a biasing force of a spring 89. The cam follower 88 penetrates through a long hole 1*p* (see FIG. 2E) of a frame wall 1*w* of the outer frame 1, and the cam follower 88 is coupled to the positive electrode 2. The cam follower 88 is linearly moved up and down along a guide shaft 89*g* orthogonal to the rotating shaft of the driven shaft 86. On the other hand, a central portion in the longitudinal direction of each positive electrode 2 is swingably supported by the outer frame 1 using the insulator support member 79, and one end of each positive electrode 2 is coupled to the cam follower 88 through a connecting unit 88*a* such as a universal joint or a spherical bearing, which allows the positive electrode 2 to be swung about the insulator support member 79 according to the movement of the cam follower 88. As a result, as shown in FIG. 7, the positive electrode 2 is swung about the insulator support member 79 by the up and down motion of the cam follower 88. When the support point of the positive electrode 2 with the insulator support member 79 is set to the center of the plasma generation position, the positive electrode 2 is swung about the center of the plasma generation position.

Using the control unit 32*a* connected to the positive electrode drive unit 31*a*, the operation is controlled such that the positive electrode drive unit 31*a* is stopped while the positive electrode is displaced or such that its drive speed is changed. Therefore, the atom density per unit time can be varied by changing a residence time of each attitude in the positive electrode 2.

By performing the swing operation of the positive electrode 2 like FIG. 7, the atom beam density can be increased and decreased at the ends of the atom emission unit while the atom beam density is kept constant at the vicinity of the center of the atom emission unit in the axial direction of the negative electrode.

In another example shown in FIG. 8, in place of the swing motion of FIG. 7, while the parallel state is maintained between the positive electrode 2 and the atom emission unit 5, the positive electrode 2 is displaced along a vertical direction in FIG. 8 (radial direction of the positive electrode 2 and direction orthogonal to the surface of the atom emission unit 5) such that the distance between the positive electrode 2 and the atom emission unit 5 is shortened and lengthened. Therefore, the atom density can be varied. As with the example of FIG. 7, a positive electrode drive unit 31*b* which is of an example of the positive electrode drive unit 31 can be formed by the motor, cylinder, or electromagnet which is an example of the drive source, and the positive electrode drive unit 31*b* can be configured in the same way as the positive electrode drive unit 31*a*. Unlike the example of FIG. 7, because the positive electrode 2 is simply vertically moved, the connecting unit 88*a* such as the universal joint or the spherical bearing which permits the swing motion of the positive electrode 2 is not required, but only one end of the cam follower 88 is coupled and fixed to the positive electrode 2. Therefore, the connecting structure can be simplified. As with the control unit 32*a* of FIG. 7, a control unit 32*b* which is of an example of the control unit 32 outputs the drive control signal for displacing the positive electrode 2 to the positive electrode drive unit 31*b*. The control unit 32*b* stops the vertical movement of the positive electrode 2, or the control unit 32*b* changes the operation speed. Therefore, the atom density per unit time may be varied by changing the residence time of each attitude of the positive electrode 2.

By performing the parallel operation of the positive electrode 2 like FIG. 8, the atom beam emission can be performed with the atom density having an even gradient. More specifically, the atom beam emission can be performed with the density having a smooth gradient toward the movable positive electrode on the basis of the fixed negative electrode of the atom emission unit.

In still another example shown in FIG. 9, while the distance between the positive electrode 2 and the atom emission unit 5 is kept constant, the positive electrode 2 is displaced along a crosswise direction (in the radial direction of the positive electrode 2 and along the surface of the atom emission unit 5). Therefore, the atom density can be varied. As with the examples of FIGS. 7 and 8, a positive electrode drive unit 31*c* which is an example of the positive electrode drive unit 31 can be formed by a motor, a cylinder, or an electromagnet which is an example of the drive source, and the positive electrode drive unit 31*c* can be configured in the same way as the positive electrode drive unit 31*b*. Unlike the example of FIG. 7, because the positive electrode 2 is simply moved in the crosswise direction, the connecting unit 88*a* such as the universal joint or the spherical bearing which permits the swing motion of the positive electrode 2 is not required, but only one end of the cam follower 88 is coupled and fixed to the positive electrode 2. Therefore, the connecting structure can be simplified. As with the control unit 32*a* in FIG. 7, a control unit 32*c* which is an example of the control unit 32 outputs the drive control signal for displacing the positive electrode 2 to the positive electrode drive unit 31*c*. The control unit 32*c* stops the movement in the crosswise direction of the positive electrode 2, or the control unit 32*c* changes the operation speed. Therefore, the atom density per unit time may be varied by changing the residence time of each attitude of the positive electrode 2.

By performing the crosswise displacement operation of the positive electrode 2 like FIG. 9, the atom beam emission can be performed with the atom density having an even gradient. More specifically, the atom beam emission can be performed with the density having an almost even gradient as a whole while the density is steeply increased and decreased only at the end portion (movable positive electrode side) of the atom emission unit.

Figure 10:
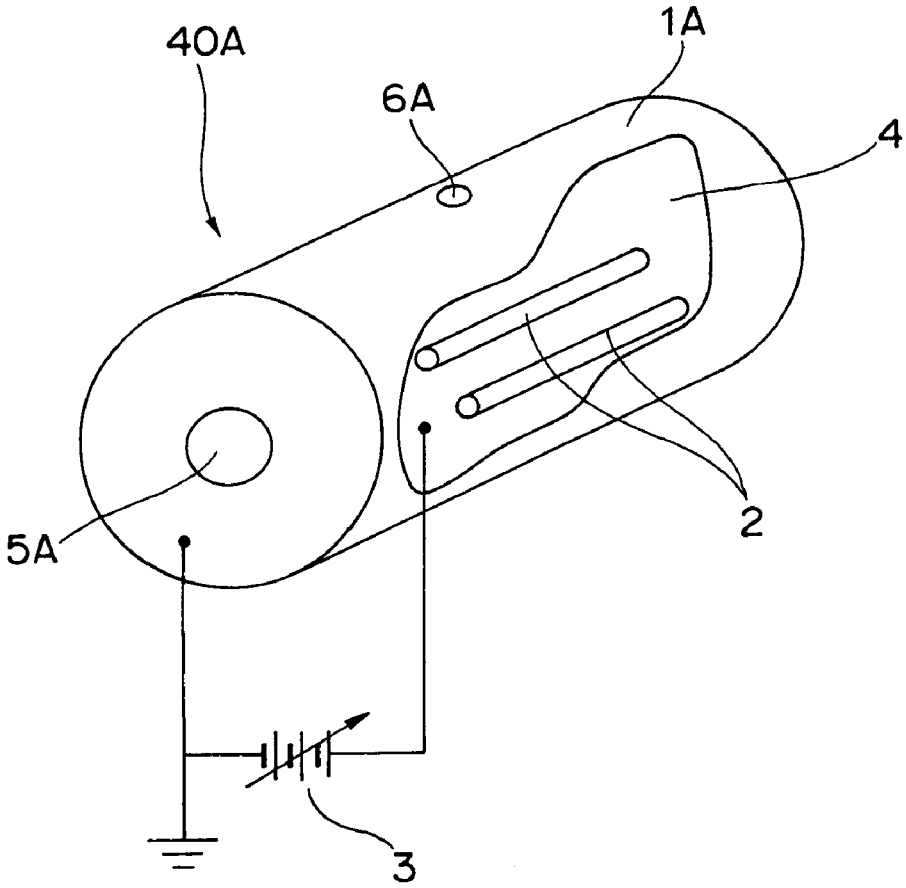
FIG. 10 is a perspective view showing a fast atom bombardment source of a modification example of the first embodiment shown in FIG. 1 where the fast atom bombardment source is partly broken.

FIG. 10 is a perspective view showing a fast atom bombardment source 40A according to a modification example of the first embodiment where the fast atom bombardment source 40A is partly broken. The outer frame 1 of the fast atom bombardment source shown in FIG. 1 is formed in the rectangular shape. On the other hand, in the modification example, an outer frame 1A is formed in a cylindrical shape, an atom emission unit 5A is formed as a circular shape portion located in a central portion of one circular end face in the axial direction of the cylindrical outer frame 1A, and a gas introduction unit 6A is formed in a curved circumferential surface of the cylindrical outer frame 1A.

According to the atom bombardment source shown in FIG. 10, the atom beam emission with the high atom beam emission density within a narrow range can be performed onto the target.

Figure 11:
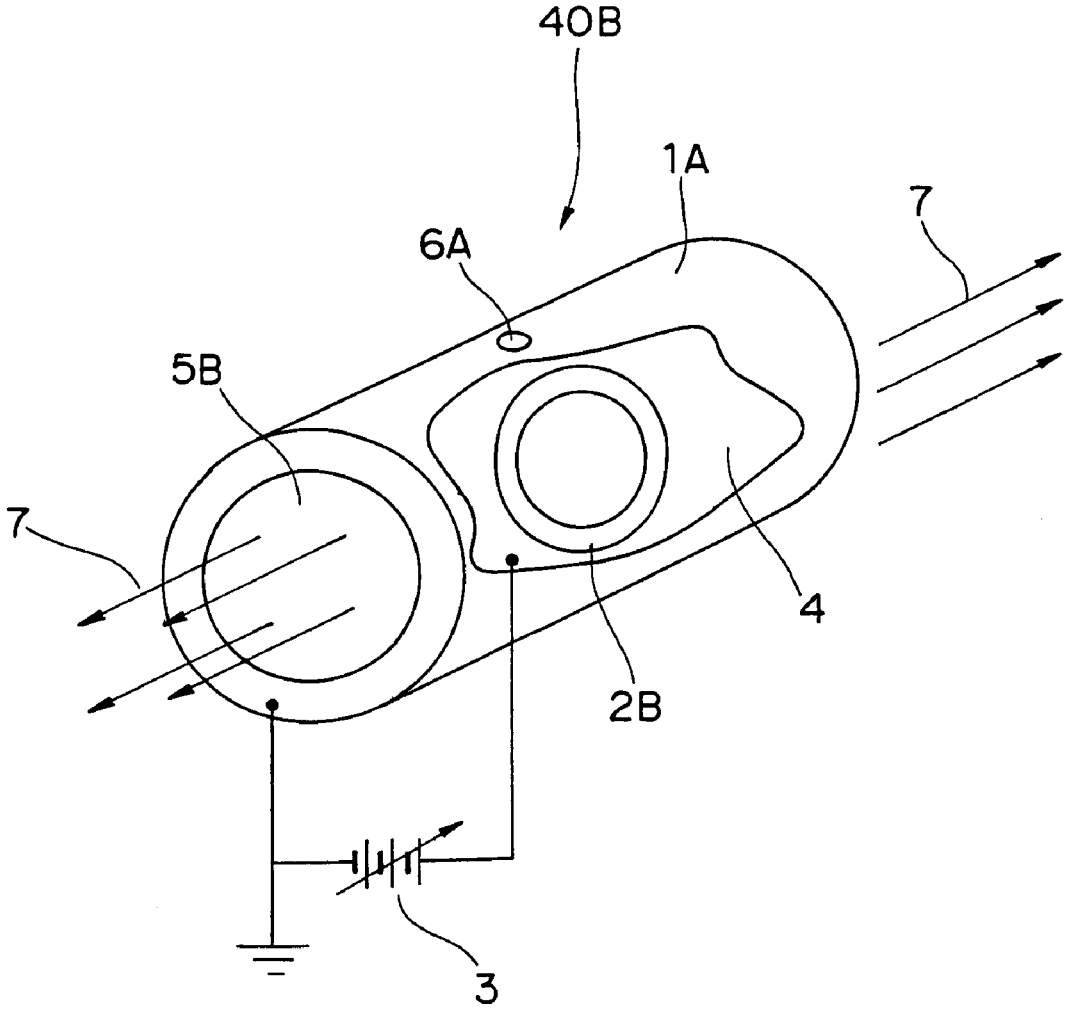
FIG. 11 is a perspective view illustrating a fast atom bombardment source according to a second embodiment of the present invention where the fast atom bombardment source is partially broken.

FIG. 11 is a perspective view showing a fast atom bombardment source 40B according to a second embodiment of the invention where the outer frame 1A of the fast atom bombardment source 40B is partially broken. In the following description, the same component as the first embodiment is designated by the same reference numeral, and the detailed description is omitted.

The second embodiment differs from the first embodiment as follows. The outer frame 1A of the fast atom bombardment source 40B is formed in the cylindrical shape, a ring-shape positive electrode is used as a positive electrode 2B installed in the fast atom bombardment source 40B, atom emission units 5B are formed in a disc larger than the atom emission unit 5A in FIG. 10 according to the ring-shaped positive electrode 2B, and the atom emission units 5B are arranged in end faces on both sides in the axial direction of the outer frame 1A.

According to the atom bombardment source shown in FIG. 11, the atom beam emission at a broader range than that of the atom bombardment source shown in FIG. 10 can be performed onto the target.

FIGS. 12A to 14 are explanatory views showing examples of the arrangements and displacement operations of the positive electrode 2B in the second embodiment.

Figure 12A:
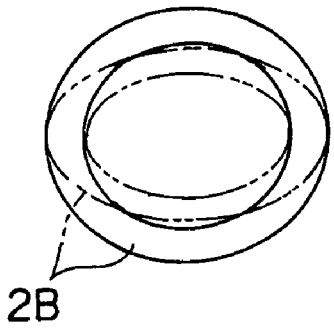
FIG. 12A is an explanatory view showing an arrangement example and its displacement operation of the positive electrode in the second embodiment.
Figure 12B:
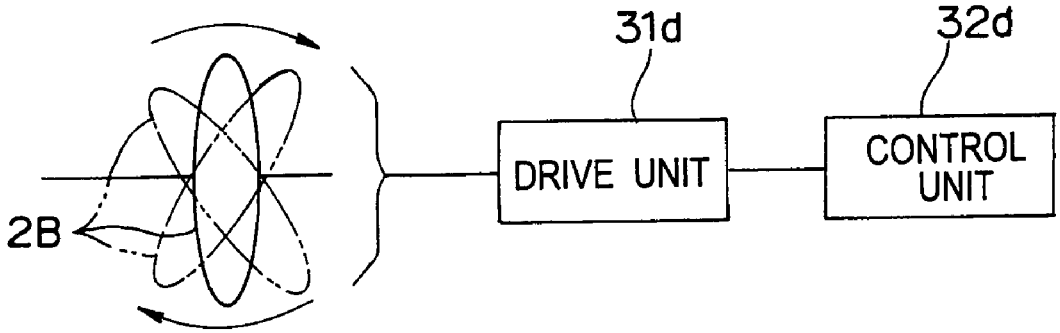
FIG. 12B is an explanatory view showing the arrangement example and its displacement operation of the positive electrode in the second embodiment.

FIG. 12A is a front view of the positive electrode 2B, and FIG. 12B is a side view showing the positive electrode 2B and the drive control system in FIG. 12A. A positive electrode drive unit 31*d* which is an example of the positive electrode drive unit 31 is repeatedly rotated about a center line of the ring-shaped positive electrode 2B as shown by an alternate long and short dash line, which changes the distance between the positive electrode 2B and the atom emission unit 5B in FIG. 11. A control unit 32*d* which is an example of the control unit 32 outputs the drive control signal for displacing the positive electrode 2B to the positive electrode drive unit 31*d*.

The control unit 32*d* stops the positive electrode drive unit 31*d* during the operation, or the control unit 32*d* changes the operation speed. Therefore, the atom density per unit time can be varied by changing the residence time of each attitude of the positive electrode 2B.

By performing the displacement operation of the positive electrode 2 of FIGS. 12A and 12B, the atom beam emission can be performed with a density distribution symmetrically on the center of the atom emission unit (the center of the ring-shaped positive electrode)

Figure 13:
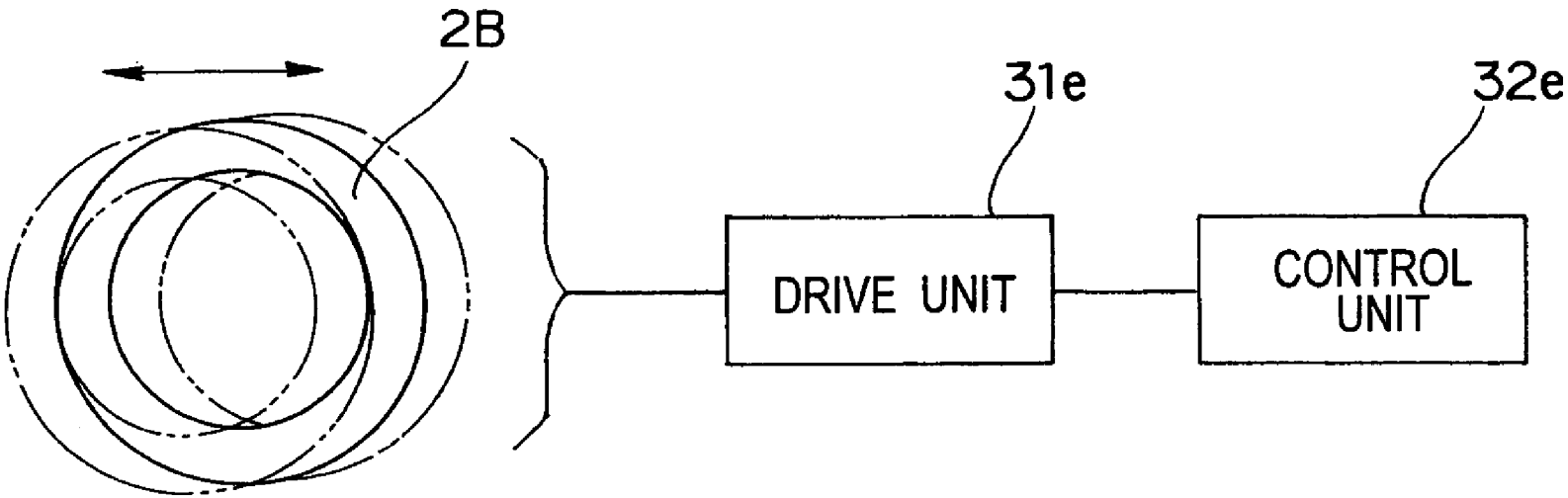
FIG. 13 is an explanatory view showing an arrangement example and its displacement operation of the positive electrode in the second embodiment.

In the example shown in FIG. 13, while the parallel state is maintained between the positive electrode 2B and the atom emission unit 5B, the positive electrode 2B is displaced along the crosswise direction (horizontal direction in FIG. 13 and direction orthogonal to the axial direction of the outer frame 1A in FIG. 11) by a positive electrode drive unit 31*e* which is an example of the positive electrode drive unit 31. Therefore, the atom density can be varied. As with the example shown in FIG. 12, a control unit 32*e* which is an example of the control unit 32 outputs the drive control signal for displacing the positive electrode 2B to the positive electrode drive unit 31*e*, and the positive electrode drive unit 31*e* is controlled by the control unit 32*e* such that the positive electrode drive unit 31*e* is stopped while the positive electrode 2B is displaced or such that the drive speed is changed. Therefore, the atom density per unit time may be varied by changing a residence time of each attitude of the positive electrode 2B.

By performing the displacement operation of the positive electrode 2 of FIG. 13, the atom beam emission can be performed in a state where the density at a position of the positive electrode closer to the outer frame (negative electrode) is increased.

Figure 14:
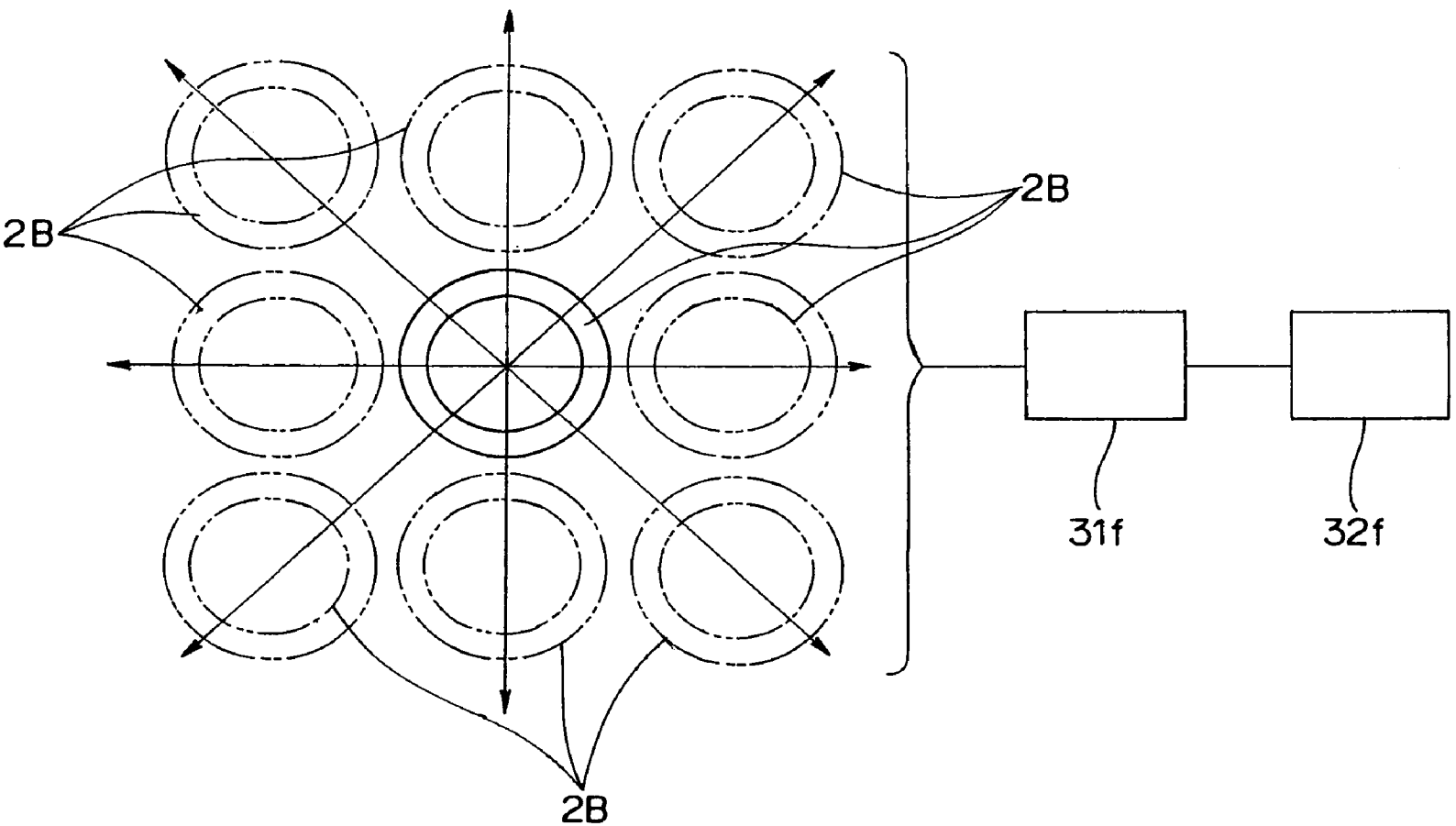
FIG. 14 is an explanatory view showing an arrangement example and its displacement operation of the positive electrode in the second embodiment.

In the example shown in FIG. 14, while the distance between the positive electrode 2B and the atom emission unit 5B is kept constant, the positive electrode 2B is displaced along the vertical direction, the crosswise direction, and the oblique direction in FIG. 14 by a positive electrode drive unit 31*f* which is an example of the positive electrode drive unit 31. Therefore, the atom density can be varied. As with the example of FIG. 12, a control unit 32*f* outputs the drive control signal for displacing the positive electrode 2B to the positive electrode drive unit 31*f*, and the positive electrode drive unit 31*f* is controlled by the control unit 32*f* such that the positive electrode drive unit 31*f* is stopped while the positive electrode 2B is displaced or such that the drive speed is changed. Therefore, the atom density per unit time may be varied by changing a residence time of each attitude of the positive electrode 2B.

By performing the displacement operation of the positive electrode 2 of FIG. 14, the atom beam emission having a high atom beam density can be locally performed in a case where the positive electrode 2 is smaller than the atom emission unit (outer frame (negative electrode)). Therefore, it is preferable to selectively perform the atom beam emission on the irradiating surface of the target.

In the above embodiments and modification examples shown in FIGS. 8 to 14, each drive unit has the same structure as the drive unit 31*a* in FIG. 7, and a known mechanism may appropriately be used when conversion in the transmission direction of the driving force is required.

The present invention is not limited to the above described embodiments and modification examples, and the present invention can be realized in various modes.

For example, in addition to the above embodiments and modification examples, as other examples of displacement of the positive electrode 2 or 2B, it is possible that a voltage for applying to the positive electrode 2 or 2B is increased immediately before starting displacement of the positive electrode 2 or 2B and then, the displacement of the positive electrode 2 or 2B can be performed. In such a way, by displacing the positive electrode 2 or 2B after increasing the voltage, the plasma at an initial plasma generation when the voltage application is started can be stabilized. Moreover, the displacement of the positive electrode 2 or 2B can be performed while a voltage for applying to the positive electrode 2 or 2B is increased and decreased during the displacement of the positive electrode 2 or 2B. In such a way, by increasing and decreasing the voltage during the displacement of the positive electrode 2 or 2B, that is, by increasing the voltage when the distance between the plural positive electrodes 2 or 2B is increased and by decreasing the voltage when the distance between the plural positive electrodes 2 or 2B is decreased. Thus, the atom density per unit time of the atom beams emitted before the displacement of the positive electrodes 2 or 2B and the atom density per unit time of the atom beams emitted during and after the displacement of the positive electrodes 2 or 2B can be kept almost constant.

Although the two fast atom bombardment sources 19 and 20 are arranged in FIG. 2A, only the fast atom bombardment source 19 may be arranged. Therefore, as shown in FIG. 2F, the optimum configuration can be obtained in the case where the surface treatment such as surface cleaning is performed to the surface of the substrate 12.

Figure 2F:
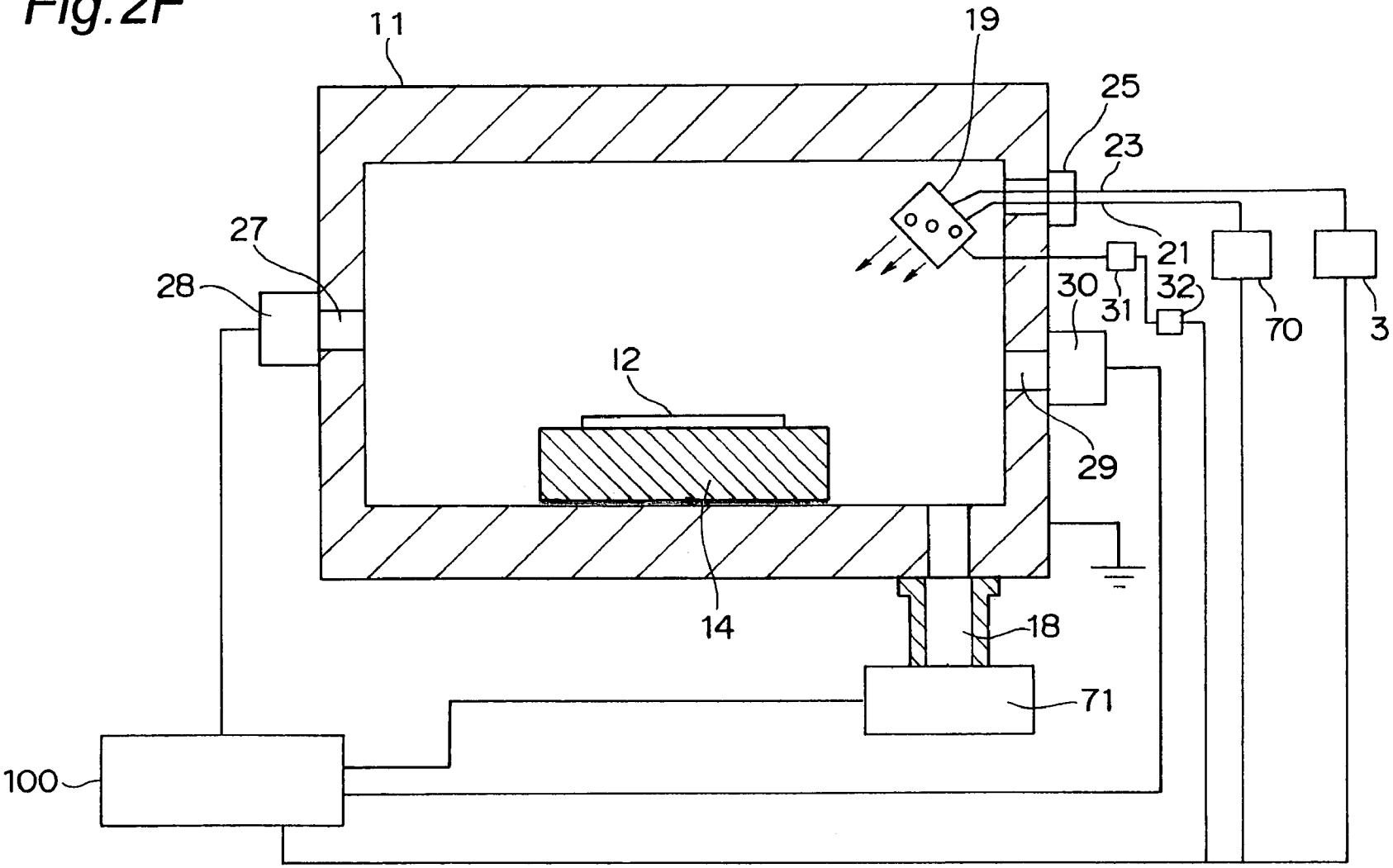
FIG. 2F is a schematic view showing a configuration of an example in which only one fast atom bombardment source is arranged in a surface treatment apparatus provided with the fast atom bombardment source according to the first embodiment.

According to the arrangement of FIG. 2F, when only one surface of the target is cleaned, the apparatus arrangement can be simplified.

In the modification examples of the positive electrodes 2 and 2B, the positive electrode on the near side of the substrate of the plurality of positive electrodes 2 and 2B is separated away from the substrate, and the positive electrode is left away from the substrate, which possibly causes the plasma to disappear. Therefore, preferably the positive electrodes 2 and 2B are moved to the original position or the position where the positive electrodes 2 and 2B are brought closer to the substrate compared with the original position, and preferably the positive electrodes 2 and 2B are reciprocally moved at predetermined intervals. Preferably the position is displaced to about 1 cm at most.

Depending on the size of the atom emission unit (outer frame (negative electrode)) and the positive electrode, if the displacement of the position is less than 1 cm, the strength of the plasma becomes too large, it is possible to give any damage to the positive electrode or the negative electrode. Therefore, the displacement of the position is about 1 cm, preferably.

The target substrates 12 and 13 can be applied to the wafer ranging from 4 to 12 inches in terms of wafer level. For example, the fast atom bombardment source having a size of 190 mm×280 mm×100 mm can be used in the case of the 6-inch wafer. In this case, preferably the atom emission unit 5 has the size of about 20 cm×about 20 cm.

Figure 15A:
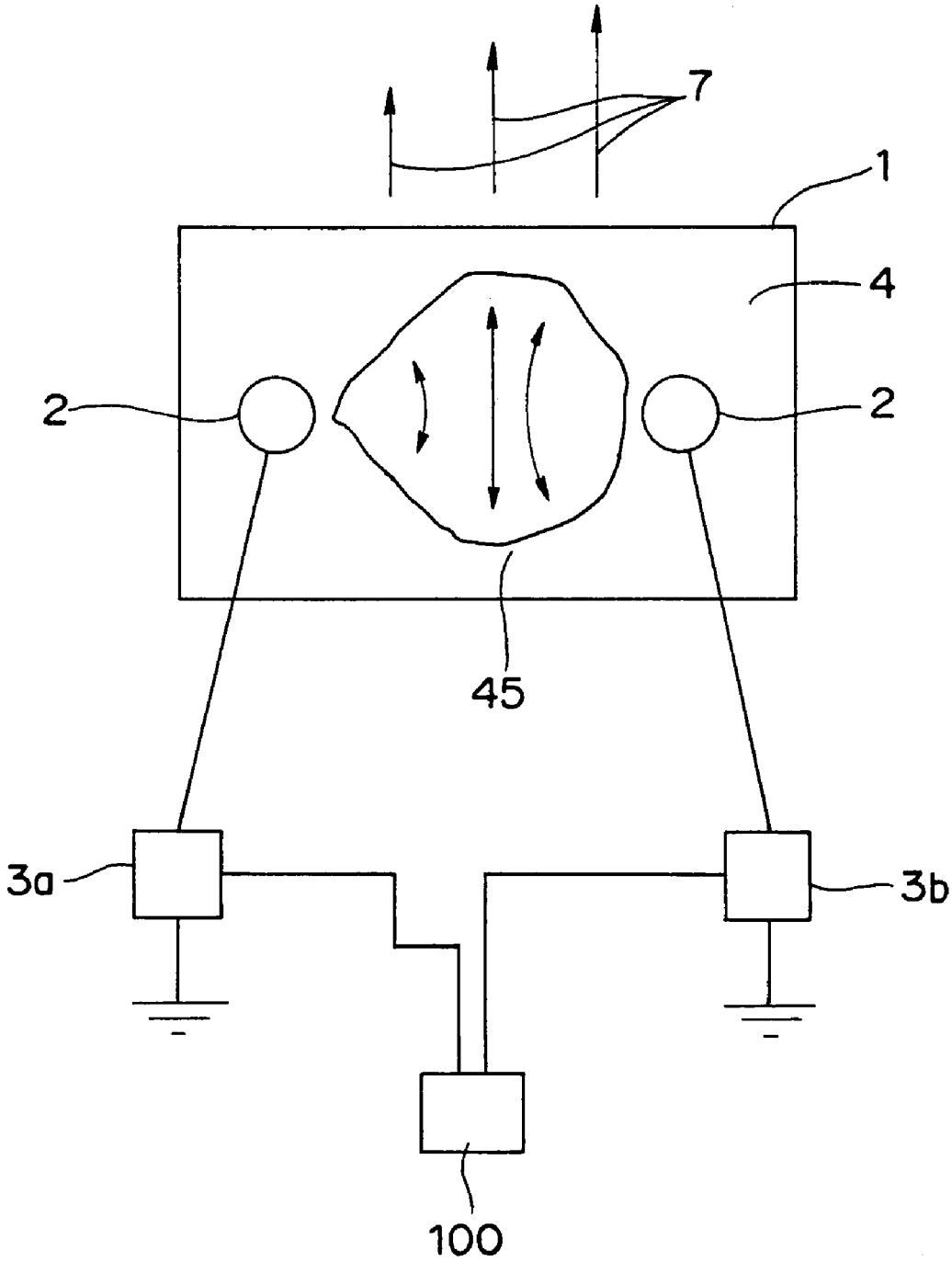
FIG. 15A is a planar explanatory view showing an emission atom density distribution of a fast atom bombardment source in another modification example of the first embodiment of the present invention.
Figure 15B:
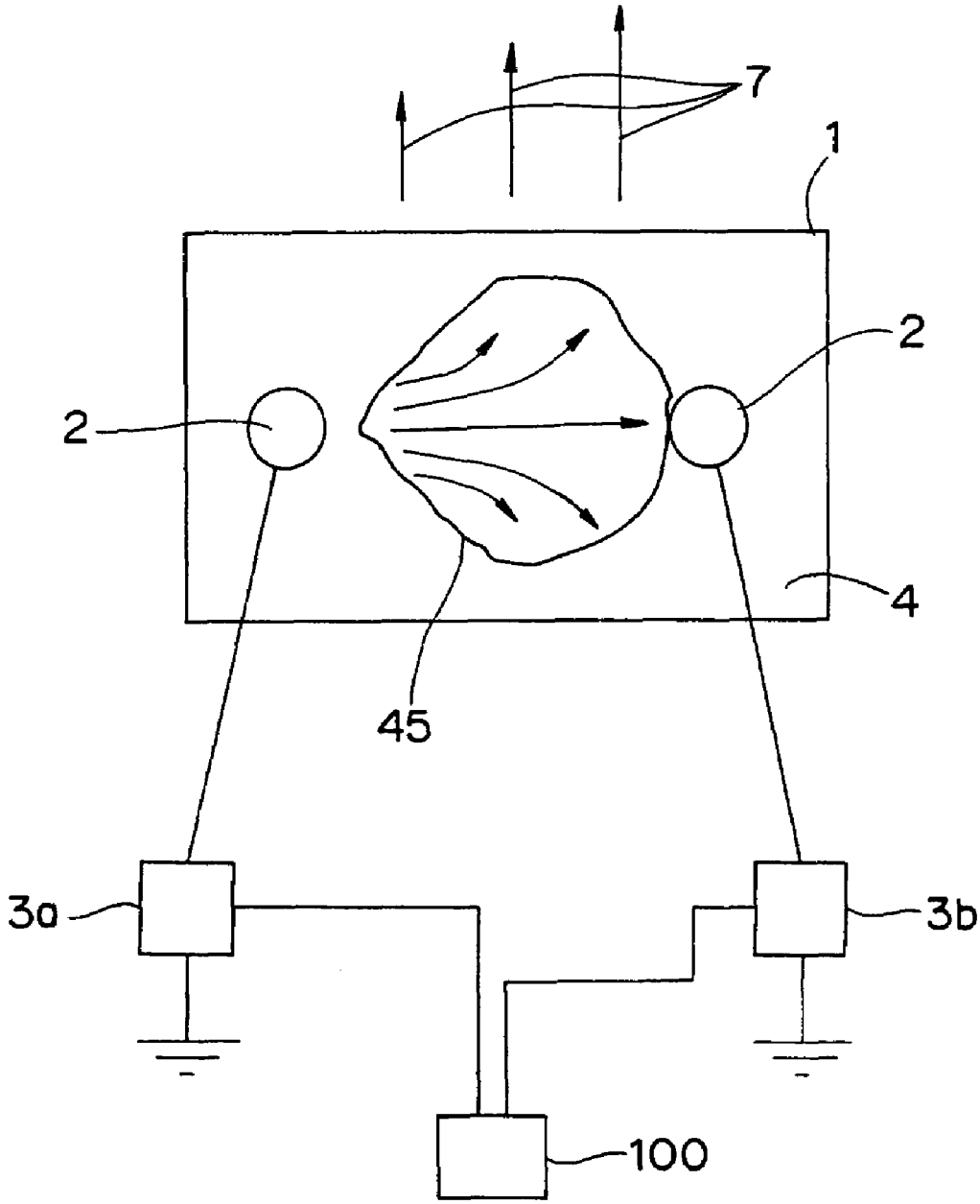
FIG. 15B is a planar explanatory view showing an emission atom density distribution of a fast atom bombardment source in still another modification example of the first embodiment of the present invention.

The same voltage is applied to the plurality of positive electrodes 2 and 2B from one power supply. Additionally, in a modification example shown in FIGS. 15A and 15B, direct-current high-voltage power supplies 3*a* and 3*b* are provided in the plurality of positive electrodes 2 and 2B respectively and the voltage may separately be applied to each of the positive electrode 2 from the direct-current high-voltage power supplies 3*a* and 3*b*. In such cases, the different voltages can separately be applied to the positive electrodes 2 and 2B. In FIG. 15A, the control device 100 performs the control such that the direct-current high-voltage power supply 3*b* applies the voltage lower than that of the left-side positive electrode 2 to the right-side positive electrode 2. In this case, initially, as shown in FIG. 15A, the plasma 45 is formed at the position closer to the right-side positive electrode 2 than the left side-positive electrode 2. Then, as shown in FIG. 15B, the plasma 45 is formed from the left-side positive electrode 2 toward the right-side positive electrode 2. Therefore, many atom beams 7 are emitted at the position closer to the right-side positive electrode 2.

By displacement as shown in FIGS. 15A and 15B, the plasma can be moved toward the positive electrode 2 while the plasma maintains a stable state.

In the specification, the atoms are emitted. However, the ions can also be emitted from the plasma generated in the outer frame.

By properly combining arbitrary embodiments of the aforementioned various embodiments, the effects owned by each of them can be made effectual.

The same effects can also be obtained when the above embodiments and modification examples are arbitrarily combined as appropriate.

The present invention can be applied to the fast atom bombardment source device, fast atom beam emission method, and surface modification apparatus in the fields of the semiconductor device production process, MEMS (Micro Electro Mechanical System), room-temperature bonding, and the like. In such fields, the fast atom bombardment source device, fast atom beam emission method, and surface modification apparatus are used in forming, producing, machining, and the like in material processing such as sputtering, evaporation, etching, surface cleaning, and deposition; and a nano-machining field. Particularly, the present invention is effectively applied to the target having a large processing area and the case in which the distance cannot be kept constant between the processing surface and the fast atom bombardment source due to the apparatus configuration or processing characteristics.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An atom bombardment source comprising:

a cylindrical body which is partially opened, serves as a negative electrode and having an emission unit capable of emitting atoms, for generating plasma therein;

a positive electrode which is arranged in the cylindrical body;

a power supply which is electrically connected to the positive electrode, for applying a voltage to the positive electrode to generate the plasma in the cylindrical body to emit the atoms from the emission unit; and a positive electrode drive unit for displacing the positive electrode with respect to the emission unit in the cylindrical body.

2. The atom bombardment source according to claim 1, wherein the positive electrode is formed in a rod or a ring.

3. The atom bombardment source according to claim 1, further comprising a control unit for controlling the positive electrode drive unit to displace the positive electrode to be brought close to or separated away from the emission unit at predetermined intervals.

4. The atom bombardment source according to claim 1, further comprising a control unit for controlling the voltage applied to the positive electrode from the power supply in association with the displacement of the positive electrode.

5. A surface modification apparatus for emitting atoms to a target from an atom bombardment source to perform surface modification of the target, plasma being generated in a cylindrical body of the atom bombardment source, in which an emission center axis along which the atoms are emitted from the atom bombardment source is obliquely provided with respect to an axis perpendicular to a surface of the target placed on a placement stage, and the atom bombardment source is formed by the atom bombardment source according to claim 1.

6. An atom beam emission method comprising:

applying a voltage to a positive electrode in a cylindrical body with the cylindrical body set to a negative electrode to generate plasma in the cylindrical body;

emitting atoms from an emission unit capable of emitting the atoms with a part of the cylindrical body having an opening serving as the negative electrode; and displacing the positive electrode with respect to the emission unit in the cylindrical body by use of a positive electrode drive unit.

7. The atom beam emission method according to claim 6, wherein the plasma is generated in the cylindrical body to emit the atoms from the emission unit while the positive electrode drive unit is controlled to displace the positive electrode with respect to the emission unit at predetermined intervals.

8. The atom beam emission method according to claim 6, wherein with a plurality of rod-shaped positive electrodes arranged as the positive electrode, with longitudinal axis directions of the plurality of rod-shaped positive electrodes substantially parallel to the emission unit and with the emission unit inclined with respect to a surface of a target to which the atoms are emitted, at least the positive electrode which is located close to the target is displaced with respect to the emission unit in the plurality of rod-shaped positive electrodes while the plasma is generated in the cylindrical body to emit the atoms from the emission unit.

9. The atom beam emission method according to claim 6, wherein the plasma is generated in the cylindrical body to emit the atoms from the opening while the voltage applied to the positive electrode from a power supply is controlled in association with the displacement of the positive electrode.

* * * * *